US005446793A

United States Patent [19]

Piccaluga et al.

[11] Patent Number: 5,446,793

[45] Date of Patent: Aug. 29, 1995

[54] METHOD OF IMPROVING THE QUALITY OF SOUND REPRODUCTION AND APPARATUS FOR CARRYING AT LEAST ONE LOUDSPEAKER EMITTING IN THREE DIRECTIONS

[76] Inventors: Pierre Piccaluga; Claude A. Perrichon, both of Thurissey, F-71260 Montbellet, France

[21] Appl. No.: 64,119

[22] PCT Filed: Oct. 16, 1991

[86] PCT No.: PCT/FR91/00803

§ 371 Date: May 24, 1993

§ 102(e) Date: May 24, 1993

[87] PCT Pub. No.: WO92/07448

PCT Pub. Date: Apr. 30, 1992

[30] Foreign Application Priority Data

Oct. 16, 1990 [FR] France ..... 90 12757

[51] Int. Cl.[6] ..... H04R 25/00

[52] U.S. Cl. ..... 381/188; 381/154; 181/199

[58] Field of Search ..... 381/159, 154, 188, 156, 381/158, 152, 24, 88, 89, 90; 181/152, 156, 187, 189, 199, 159, 179, 185

[56] References Cited

U.S. PATENT DOCUMENTS

| | | | |
|---|---|---|---|
| 3,590,942 | 7/1971 | Globs . | |
| 3,677,938 | 1/1972 | Kuhlow et al. | 381/24 |
| 3,722,616 | 3/1973 | Beavers . | |
| 3,739,096 | 4/1973 | Iding . | |
| 4,756,382 | 7/1988 | Hudson, III . | |
| 4,783,820 | 11/1988 | Lyngdorf et al. | 381/89 |
| 4,811,403 | 3/1989 | Henricksen et al. | 381/159 |
| 4,819,761 | 4/1989 | Dick | 381/158 |
| 4,819,761 | 4/1989 | Dick . | |
| 5,058,169 | 10/1991 | Temmer | 181/144 |

FOREIGN PATENT DOCUMENTS

| | | | |
|---|---|---|---|
| 319437 | 6/1989 | European Pat. Off. . | |
| 0796407 | 4/1936 | France | 181/152 |
| 1472933 | 2/1967 | France . | |
| 0032701 | 3/1978 | Japan | 381/24 |
| 0302998 | 12/1989 | Japan | 381/159 |
| 0060399 | 2/1990 | Japan | 381/159 |
| 4216300 | 8/1992 | Japan | 381/159 |
| 2250157 | 5/1992 | United Kingdom | 381/159 |

*Primary Examiner*—Curtis Kuntz
*Assistant Examiner*—Huyen D. Le
*Attorney, Agent, or Firm*—Beveridge, DeGrandi, Weilacher & Young

[57] ABSTRACT

A sound reproducing apparatus includes a tube which is open at both ends, and an open-sided cavity which is adjacent to the tube. A membrane seal is provided between the cavity and the tube. An electro-acoustic transducer, disposed half in the tube and half in the cavity, divides the tube into forward and rear emission areas which are sealed from each other. In the cavity, the transducer defines a lateral emission area which extends laterally with respect to the transducer axis and is in quadrature with the forward and rear emission areas. In another embodiment the tube is nonlinear and there are two transducers which are located respectively in the tube and in the cavity. The method utilizes two transducers with parallel axes. The first transducer emits sound forwardly and rearwardly into sealed apart first and second emission areas. The second transducer emits sound in a direction which is lateral with respect to the transducer axes, into a third emission area which is sealed from the first and second emission areas.

16 Claims, 4 Drawing Sheets

METHOD OF IMPROVING THE QUALITY OF SOUND REPRODUCTION AND APPARATUS FOR CARRYING AT LEAST ONE LOUDSPEAKER EMITTING IN THREE DIRECTIONS

BACKGROUND OF THE INVENTION

The present invention concerns a method of improving the quality of mono or stereo sound reproduction.

It also concerns apparatus for carrying out the method.

Various devices are currently used to reproduce sound. They usually comprise two "enclosures" comprising one or more electro-acoustical transducers called "loudspeakers". Each enclosure usually houses three loudspeakers respectively emitting low, medium and high frequencies. The loudspeakers employ various materials or technologies with a view to improving the reproduction of sound. The "timbres" of these loudspeakers are nowadays very close to the original sound but the problem of spatial resolution has not been solved. These loudspeakers do not reproduce the recorded sound faithfully because they emit sound in one direction only which is always perpendicular to the open side of the enclosure and the same as the direction in which the conical diaphragm of the loudspeaker diverges (this single direction corresponds to the emission denoted $E_1$ hereinafter, see FIG. 1 in particular). These enclosures are cavities closed on five sides and the loudspeakers are always placed facing the open side, in other words the main axis of the conical diaphragm of the loudspeaker is always perpendicular to the open side of the cavity.

Also known are devices using so-called "bass reflex" enclosures which emit sound in two directions, a forward direction corresponding to the direction in which the diaphragm diverges (as in the loudspeaker emitting sound in a single direction) and a rearward direction (corresponding to the emission $E_2$ hereinafter, see FIG. 1 in particular); however, this rearward emission follows a particular path in the enclosure in order to render it in phase with the forward wave. Whether these prior art devices provide a single emission direction or two emission directions, a sound is never reproduced homogeneously.

An object of the present invention is to reproduce sounds homogeneously and to improve the resolution and in particular the spatial resolution of the sound by creating sound pressure level differences between different sound emission directions.

SUMMARY OF THE INVENTION

The present invention consists in a method of reproducing sound using at least one electro-acoustic transducer which may be of any known type.

The invention consists in causing the transducer(s) to emit sound in three mutually perpendicular directions, a forward emission ($E_1$), a rearward emission ($E_2$) and a sideward emission ($E_3$) in quadrature with the other two.

A first embodiment of this method causes a transducer to emit sound in the three directions, the three sound emitting areas being then entirely sealed from each other.

Another embodiment of the method causes one transducer to emit sound in two directions, the two sound emitting areas being sealed from each other, and one transducer to emit sound in a third direction corresponding to the sideward emission.

The present invention also consists in apparatus for reproducing sound comprising at least one electro-acoustic transducer and a tube open at both ends in which the transducer is disposed perpendicularly to the axis of the tube.

According to the invention this apparatus comprises a cavity open on one side, the main axis of the transducer being parallel to the open side of the cavity, the emission of sound from this transducer being then mainly sideward.

According to another feature of the invention the transducer is located half in the tube and half in the cavity, a seal being then provided between the cavity and the tube, the part of the transducer in the tube dividing the latter into a front part providing forward emission of sound and a rear part providing rearward emission of sound, these two parts being sealed from each other.

Another embodiment comprises two transducers, one transducer housed in a tube providing the frontward and rearward emission of sound and one transducer housed in a cavity providing the sideward emission of sound.

Another embodiment comprises a plurality of tubes each comprising one transducer.

In another embodiment the cavity comprises other transducers whose main axis is in a plane parallel to the open side of the cavity, the emission of sound from all these transducers being primarily sideward. This apparatus may comprise a plurality of cavities each comprising one or more transducers.

In one embodiment the main axis of the tube is not rectilinear.

In another embodiment the open side of the cavity has a non-planar shape exposing a front part of a transducer, this part then emitting sound directly outside the cavity.

In another embodiment each cavity may comprise a fan disposed between the transducer and the closed side opposite the open side.

Apparatus in accordance with the invention is described hereinafter by way of example and with reference to the appended drawings.

DESCRIPTION OF THE PREFERRED EMBODIMENTS

Figure 1:
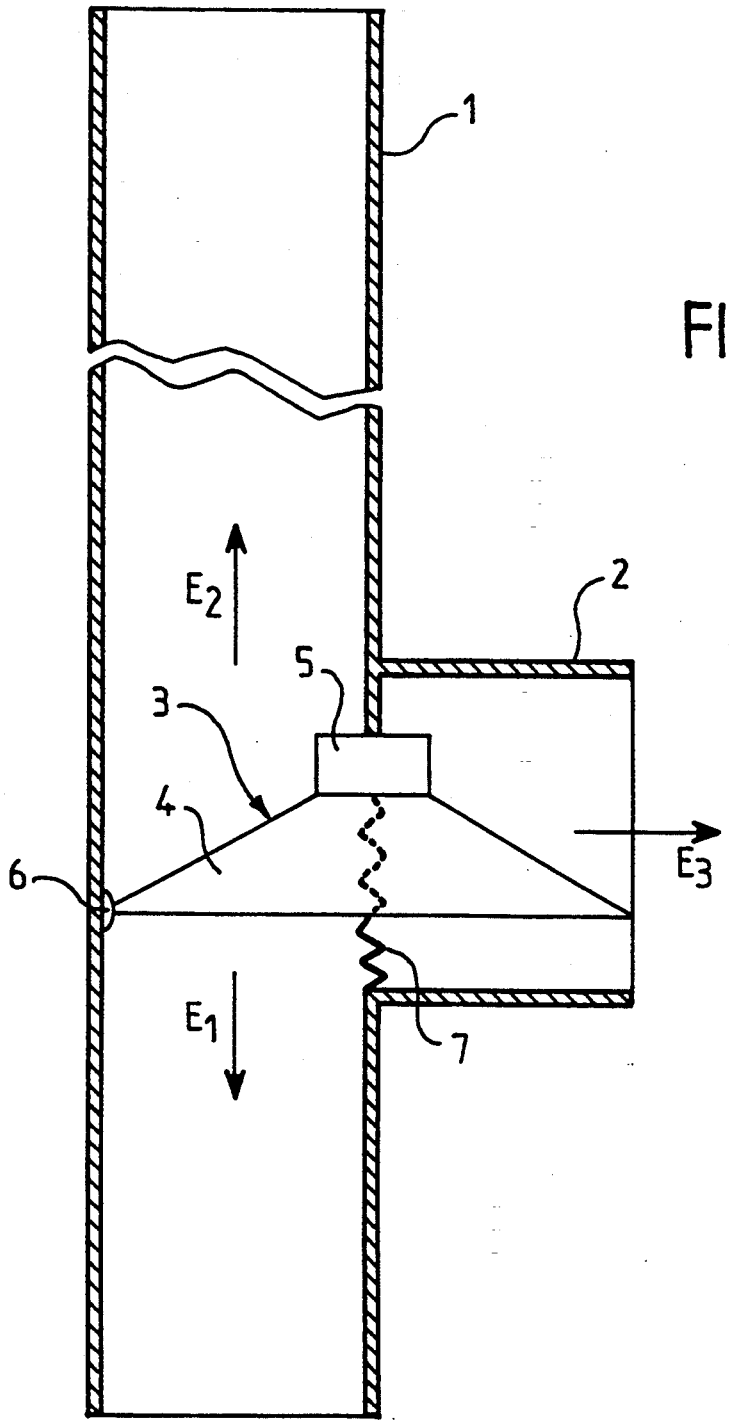
FIG. 1 shows a first embodiment of the invention comprising a single transducer, the tube and the cavity being adjacent in this case.

Referring to FIG. 1, the sound reproducing apparatus comprises a tube 1, a cavity 2 adjacent the tube and a transducer 3 mainly comprising a conical diaphragm 4 and a magnet 5. Substantially half the transducer is accommodated in the tube 1 and half in the cavity 2. A seal 6 provides a seal between the front part and the rear part of the tube, the front part corresponding to the emission area $E_1$ and the rear part corresponding to an emission area $E_2$. A seal is also provided by a flexible wall 7 separating the emission area $E_1$ and the quadrature emission area $E_3$. This flexible wall enables movement of the transducer diaphragm.

The emission area $E_1$ corresponds to a frontal area emitting sound in the usual manner; the emission area $E_2$ corresponds to a rear area; the area $E_3$ is called a short-circuit area in which the front and rear areas join.

The length of the tube is equal to ten times or four times its inside diameter, to within ±8%, and the transducer is fixed at substantially one quarter the way along the length of the tube, which corresponds to a maximum, the transducer being fixable in an area between the edge of the tube at the emission end $E_1$ and quarter-way along the length of the tube.

Figure 2:
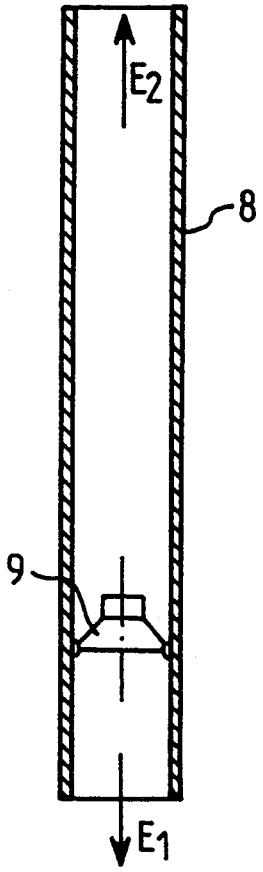
FIG. 2 shows a second embodiment comprising two transducers, one housed in the tube and the other housed in a cavity, the tube and the cavity being separate in this case.
Figure 3:
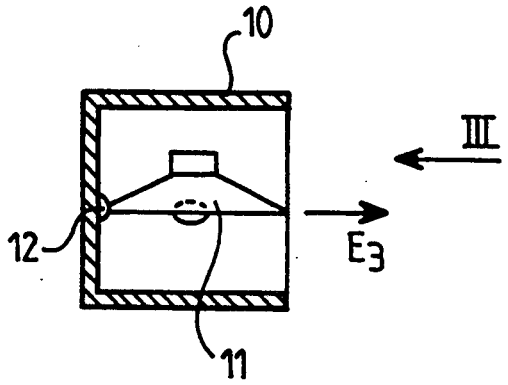
FIG. 3 is a view on III in FIG. 2.
Figure 3:
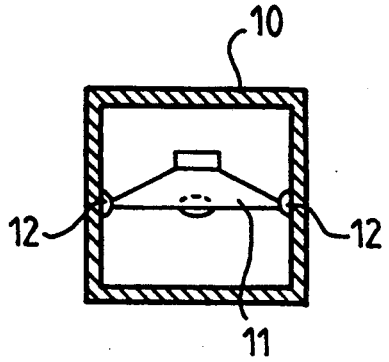

Referring to FIG. 2 the apparatus comprises a separate tube 8 and cavity 10, the tube comprising a loudspeaker 9 whose main axis is coincident with that of the tube, the cavity 10 comprising a loudspeaker 11. The main axis of this loudspeaker 11 is in a plane parallel to the open side of the cavity 10 or in other words the axis of the loudspeaker 11 is perpendicular to the emission $E_3$ which is in quadrature with the emissions $E_1$ and $E_2$ of the tube 8. The loudspeaker 11 is retained by three supports 12 fastened to the cavity. FIG. 2 shows only one support 12 mounted on the rear side of the cavity, opposite the open side, and FIG. 3 shows the other two supports 12, each mounted on one lateral side.

Figure 4:
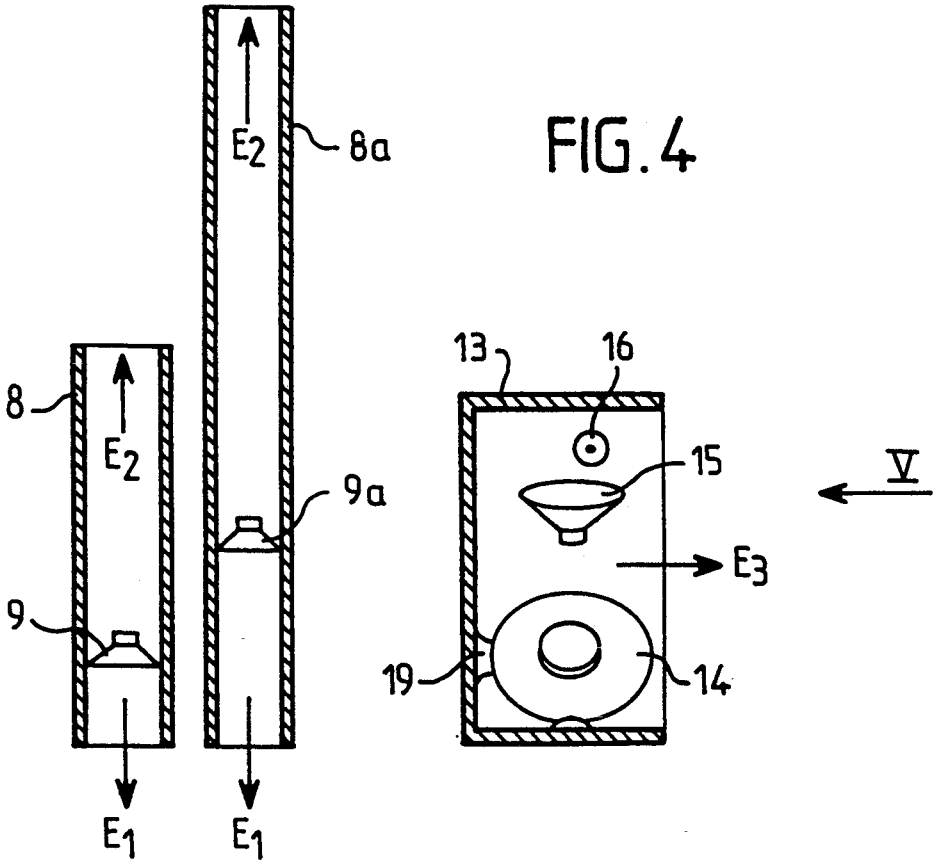
FIG. 4 shows a third embodiment comprising two tubes each provided with a transducer and a cavity enclosing three transducers.

In FIG. 4 the apparatus comprises two tubes 8, 8*a* and a cavity 13. The tube 8 comprises a loudspeaker 9 and the tube 8*a* comprises a loudspeaker 9*a*. The length of the tube 8*a* is substantially equal to ten times its inside diameter and the length of the tube 8 is substantially equal to four times its inside diameter. For example, the length of the tube 8*a* is 170 cm and the diameter of the tube, corresponding to the diameter of the loudspeaker, is 17 cm whereas the tube 8 is 84 cm long and the diameter of the tube, corresponding to the diameter of the loudspeaker, is 21 cm. Each loudspeaker is of course mounted approximately one quarter the way along the length of the tube, the emission area $E_2$ then having a length substantially equal to three times the length of the emission area $E_1$.

The cavity 13 encloses three loudspeakers, a loudspeaker 14 reproducing low notes, a loudspeaker 15 reproducing middle range notes and a loudspeaker 16 reproducing high notes.

Figure 5:
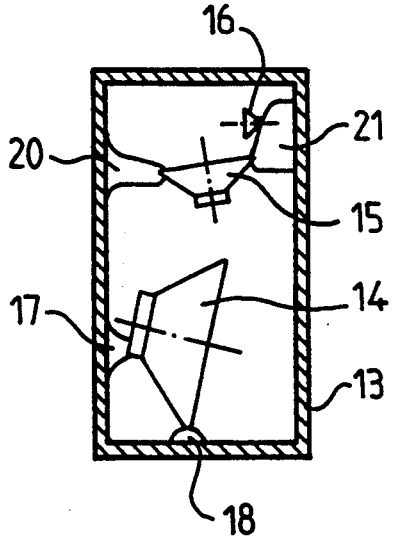
FIG. 5 is a view on V in FIG. 4.

As in FIG. 2 each loudspeaker has its main axis in a plane parallel to the open side of the cavity so that the emission $E_3$ is mainly to the side of each loudspeaker. As shown in FIG. 5, however, each loudspeaker may be oriented differently within the cavity so that the main axis of each loudspeaker is no longer necessarily vertical.

Figure 6:
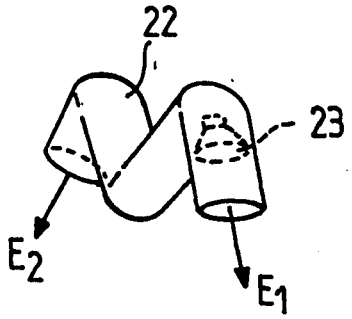
FIG. 6 shows an embodiment in which the tube is bent and the open side of the cavity has a non-planar shape.

In FIG. 6 the apparatus comprises a tube 22 enclosing a loudspeaker 23 and a cavity 24 enclosing a loudspeaker 25.

In FIG. 6 the tube 22 is bent but it could equally well have any possible shape, for example a spiral shape. The only conditions to be complied with are that the length should be equal to about four times or about ten times the inside diameter and that the loudspeaker should be positioned approximately one quarter along the length of the tube, with an area $E_1$ one third the size of the area $E_2$.

Figure 7:
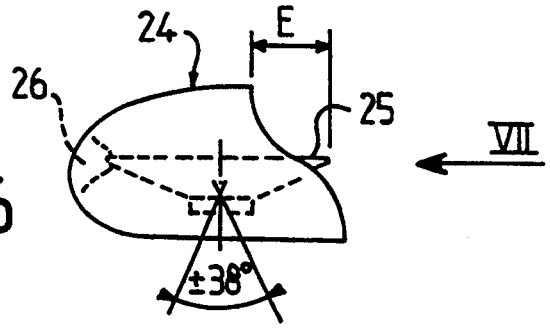
FIG. 7 is a view in cross-section on VII in FIG. 6.

In FIG. 6 the cavity 24 is oval in shape and encloses a loudspeaker 25 bearing on three supports 26, 27, 28. The supports 27 and 28 are visible in FIG. 7. The special feature of this cavity is that the loudspeaker has part of its front side visible from outside the cavity. The frontal emission E is then direct, outside the cavity, which does not degrade the quality of sound reproduction provided that the direct emission E does not exceed 40% of the emissions $E_1+E_2$. Of course, the same effect could be obtained with an open side perpendicular to the lateral sides (as in FIGS. 2 and 4) but with a transducer inclined at ±38° to a vertical axis, as shown in FIG. 6. It is then sufficient to modify the position of the support 26.

Figure 8:
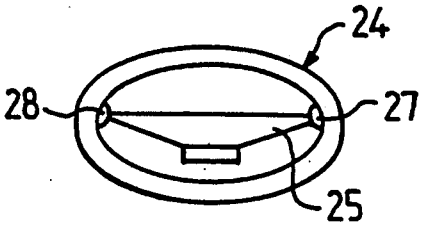
FIGS. 8 and 9 show a non-planar shape cavity enclosing three transducers.
Figure 8:
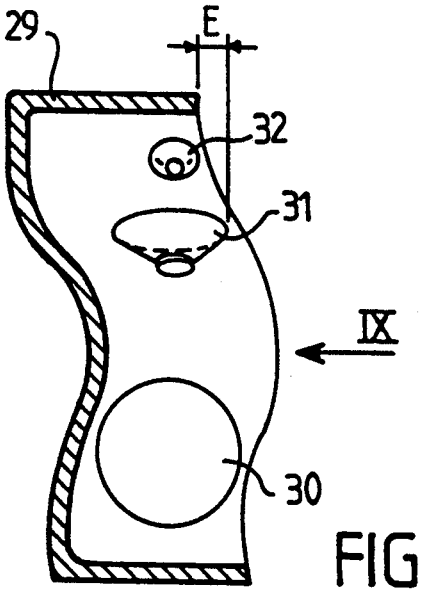
Figure 9:
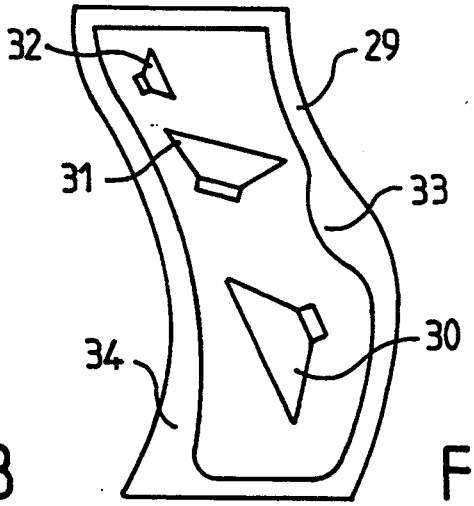

Like FIGS. 4 and 5, FIGS. 8 and 9 show a cavity comprising three loudspeakers but unlike the cavity of FIGS. 4 and 5, which is parallelepiped shape, the cavity of FIGS. 8 and 9 has a complex shape. Its interior comprises bosses 33, 34 as shown in FIG. 9. This complex shape enables direct emission of sound outside the volume (emission E, FIG. 8) but this emission must not exceed 40%, as in the case of the FIG. 6 cavity.

Figure 10:
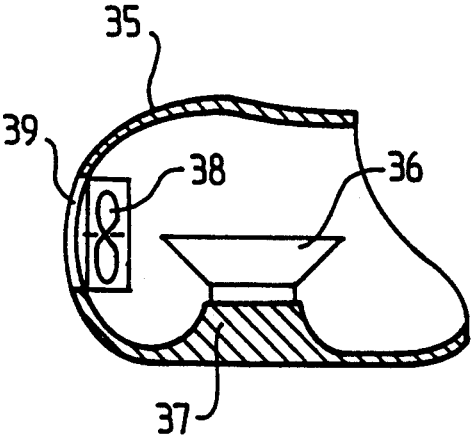
FIG. 10 shows a cavity provided with a fan drawing in air from outside.
Figure 11:
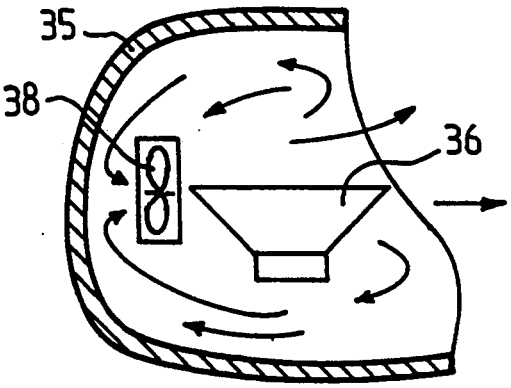
FIG. 11 shows the same cavity with the fan stirring the air in the cavity without external input of air.

FIGS. 10 and 11 show a cavity 35 comprising a fan 38 which further improves sound reproduction. This cavity 35 encloses a loudspeaker 36 mounted on a base 37.

In FIG. 10 the fan 38 draws in air from the outside of the cavity through an orifice 39. In FIG. 11 the cavity 35 has no orifice 39 and the fan 38 merely agitates the air in the cavity.

Of course, all these embodiments may be combined, meaning that apparatus in accordance with the invention may comprise for one channel or for each channel in the case of stereophonic sound one or more rectilinear or otherwise tubes of different length enclosing a loudspeaker and one or more parallelepiped-shape or curved shape cavities enclosing one or more loudspeakers.

We claim:

1. A method for reproducing sound with first and second electro-acoustic transducers which each have a transducer axis substantially parallel to each other, said method including the following steps:

emitting a forward emission of sound from said first transducer in a forward direction into a first emission area, said forward direction being forward with respect to the transducer axis of said first transducer;

emitting a rearward emission of sound from said first transducer in a rearward direction into a second emission area which is sealed from said first emission area, said rearward direction being rearward with respect to the transducer axis of said first transducer; and emitting a lateral emission of sound from said second transducer in a lateral direction into a third emission area which is sealed from said first and second emission areas, said lateral direction being lateral with respect to the transducer axes of said first and second transducers, said third emission area being in quadrature with said first and second emission areas.

2. A method according to claim 1, including the steps of directing the forward and rearward emissions of sound into a tube, and directing the lateral emission of sound into a cavity which extends laterally with respect to the transducer axis.

3. A method according to claim 1, wherein there is a further electro-acoustic transducer, said method including the step of emitting forward and rearward emissions of sound from the further transducer in directions which are substantially parallel to the forward and rearward emissions of sound from said one transducer.

4. A method according to claim 1, wherein the step of emitting a lateral emission of sound includes the step of emitting sound through a cavity with a non-planar opening.

5. A method according to claim 1, including the step of operating a fan in the third emission area.

6. A method according to claim 1, wherein the lateral emission of sound is directed into a cavity which extends laterally with respect to the transducer axis of the first transducer.

7. A method according to claim 6, including the step of emitting a lateral emission of sound in said lateral direction from a further transducer which is located in said cavity and has its axis laterally oriented with respect to said lateral direction.

8. An apparatus for reproducing sound comprising at least one tube open at both ends, a cavity adjacent to the tube and open on one side, and one electro-acoustic transducer disposed half in the tube and half in the cavity, said transducer having a transducer axis, a membrane seal provided between the cavity and the tube, said transducer dividing the tube into a forward emission area (E1) and a rearward emission area (E2) which are sealed from each other, said transducer defining in the cavity a lateral emission area (E3) which extends laterally with respect to said transducer axis and is in quadrature with the other two emission areas.

9. An apparatus according to claim 8, wherein the tube has a length which is about four times its diameter.

10. An apparatus according to claim 8, wherein the tube has a length which is about ten times its diameter.

11. An apparatus according to claim 8, wherein the forward emission area has a length which is about one-fourth of the length of the tube.

12. An apparatus for reproducing sound comprising at least one tube open at both ends, said tube having a nonlinear main axis, a cavity adjacent to and sealed from the tube and open on one side, and first and second electro-acoustic transducers, said first transducer having a first transducer axis and being disposed in the tube for dividing the tube into a forward emission area (E1) and a rearward emission area (E2) which are sealed from each other, said second electro-acoustic transducer having a second transducer axis and being disposed in the cavity to provide emissions of sound which are lateral with respect to said second transducer axis and which are in quadrature with the other two emission areas.

13. An apparatus according to claim 12 including a second tube with a further electro-acoustic transducer therein for dividing the second tube into a forward emission area and a rearward emission area which are sealed from each other.

14. An apparatus according to claim 12, wherein said cavity contains a plurality of transducers with axes which are lateral with respect to said lateral direction.

15. An apparatus according to claim 12, wherein the cavity has a non-planar opening.

16. An apparatus according to claim 12 including a fan located in said cavity.

* * * * *